US010900163B2

(12) United States Patent
Lee et al.

(10) Patent No.: US 10,900,163 B2
(45) Date of Patent: Jan. 26, 2021

(54) WASHING MACHINE

(71) Applicant: LG ELECTRONICS INC., Seoul (KR)

(72) Inventors: Junghoon Lee, Seoul (KR); Myunghun Im, Seoul (KR); Sooyoung Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 159 days.

(21) Appl. No.: 15/542,951

(22) PCT Filed: Jan. 12, 2016

(86) PCT No.: PCT/KR2016/000259
§ 371 (c)(1),
(2) Date: Jul. 12, 2017

(87) PCT Pub. No.: WO2016/114542
PCT Pub. Date: Jul. 21, 2016

(65) Prior Publication Data

US 2018/0266039 A1 Sep. 20, 2018

(30) Foreign Application Priority Data

Jan. 12, 2015 (KR) ..... 10-2015-0004429
Jan. 12, 2015 (KR) ..... 10-2015-0004430

(51) Int. Cl.
*D06F 39/08* (2006.01)
*D06F 35/00* (2006.01)
(Continued)

(52) U.S. Cl.
CPC ..... *D06F 39/088* (2013.01); *B01F 3/04248* (2013.01); *B01F 3/04262* (2013.01);
(Continued)

(58) Field of Classification Search
CPC ..... D06F 35/002; D06F 37/04; D06F 37/06; D06F 39/088; D06F 39/083; D06F 39/08
See application file for complete search history.

(56) References Cited

U.S. PATENT DOCUMENTS 5,590,551 A * 1/1997 Hong ..... D06F 17/06 261/76
2003/0230122 A1* 12/2003 Lee ..... D06F 35/002 68/58
(Continued)

FOREIGN PATENT DOCUMENTS

JP 2005-007224 1/2005
KR 10-0162306 1/1999
(Continued)

OTHER PUBLICATIONS

International Search Report (with English Translation) and Written Opinion dated May 3, 2016 issued in Application No. PCT/KR2016/000259.

*Primary Examiner* — Joseph L. Perrin
(74) *Attorney, Agent, or Firm* — KED & Associates LLP

(57) ABSTRACT

A washing machine according to the present invention comprises: a cabinet which forms an outer shape; a tub which is disposed inside of the cabinet, and in which washing water is stored; a pump which circulates the washing water stored in the tub; a circulating nozzle which sprays, into the inside of the tub, the washing water supplied from the pump; a circulating hose which connects the pump to the tub, and guides the circulated washing water to the circulating nozzle; and an atomizing unit which is disposed on the circulating hose, and atomizes the circulated washing water by mixing air. The washing machine according to the present invention supplies, into the inside of the tub through
(Continued)

an air mixer, washing water in which air is included, and thus has an advantage of reducing the total flow rate of the used washing water.

17 Claims, 18 Drawing Sheets

(51) Int. Cl.

| | |
|---|---|
| ***D06F 37/04*** | (2006.01) |
| ***B01F 5/04*** | (2006.01) |
| ***B01F 5/06*** | (2006.01) |
| ***B01F 3/04*** | (2006.01) |
| *D06F 37/06* | (2006.01) |
| *B05B 7/24* | (2006.01) |

(52) U.S. Cl.

CPC ..... *B01F 3/04503* (2013.01); *B01F 5/045* (2013.01); *B01F 5/0473* (2013.01); *B01F 5/0485* (2013.01); *B01F 5/0614* (2013.01); *B01F 5/0652* (2013.01); *D06F 35/002* (2013.01); *D06F 37/04* (2013.01); *D06F 39/08* (2013.01); *D06F 39/083* (2013.01); *B01F 2003/04319* (2013.01); *B01F 2003/04361* (2013.01); *B01F 2005/0637* (2013.01); *B01F 2215/008* (2013.01); *B05B 7/2489* (2013.01); *D06F 37/06* (2013.01)

(56) References Cited

U.S. PATENT DOCUMENTS

| | | | | |
|---|---|---|---|---|
| 2010/0263410 | A1* | 10/2010 | Oak | D06F 17/12 68/12.05 |
| 2012/0159716 | A1* | 6/2012 | Lee | D06F 35/002 8/137 |
| 2015/0176170 | A1* | 6/2015 | Bae | D06F 35/002 68/183 |
| 2016/0153134 | A1* | 6/2016 | Bang | D06F 39/083 68/13 R |

FOREIGN PATENT DOCUMENTS

| | | |
|---|---|---|
| KR | 10-0491364 | 5/2005 |
| KR | 10-2011-0102026 | 9/2011 |
| KR | 10-1287532 | 7/2013 |

* cited by examiner

WASHING MACHINE

CROSS-REFERENCE TO RELATED PATENT APPLICATIONS

This application is a U.S. National Stage Application under 35 U.S.C. § 371 of PCT Application No. PCT/KR2016/000259, filed Jan. 12, 2016, which claims priority to Korean Patent Application No. 10-2015-0004429, filed Jan. 12, 2015, and Korean Patent Application No. 10-2015-0004430, filed Jan. 12, 2015, whose entire disclosures are hereby incorporated by reference.

TECHNICAL FIELD

The present invention relates to a washing machine, and more particularly to a washing machine having an air mixer mounted therein.

BACKGROUND ART

In general, a washing machine is an apparatus that performs a washing process, a rinsing process, a spin-drying process, etc. to remove contaminants from clothing, bedding, etc. (hereinafter, referred to as 'laundry') using water, detergent, and mechanical action.

A washing machine is mainly classified as an agitator type washing machine, a pulsator type washing machine, or a drum type washing machine.

In the agitator type washing machine, a washing rod vertically disposed at the center of a washing tub is rotated in alternating directions to wash laundry. In the pulsator type washing machine, a circular rotary blade formed at the bottom of a washing tub is rotated in alternating directions to wash laundry using frictional force between a stream of water and the laundry. In the drum type washing machine, a drum is rotated in the state in which water, detergent, and laundry is received in the drum to wash the laundry.

In the drum type washing machine, a tub for receiving wash water is mounted in a cabinet forming the external appearance of the drum type washing machine, a drum for receiving laundry is disposed inside the tub, a drive unit for rotating the drum is mounted at the rear of the tub, and a drive shaft is coupled to the drive unit such that the drive shaft is connected to the rear of the drum through the tub. A plurality of lifters is mounted at the inside of the drum to lift the laundry during rotation of the drum.

DISCLOSURE

Technical Problem

It is an object of the present invention to provide a washing machine that is capable of mixing air with wash water to atomize the wash water to be sprayed.

It is another object of the present invention to provide a washing machine that enables air to be included in wash water that is sprayed into a tub to increase the spray pressure or spray angle of the wash water.

It is another object of the present invention to provide a washing machine that enables air to be included in wash water to reduce the amount of wash water that is used.

It is a further object of the present invention to provide a washing machine that is capable of effectively dissolving detergent that remains during circulation of wash water.

The objects of the present invention are not limited to the above-mentioned objects and other objects that have not been mentioned above will become evident to those skilled in the art from the following description.

Technical Solution

A washing machine according to the present invention includes a mixer body, in which wash water flows, an air introduction part formed in the mixer body for guiding air into the mixer body, and a mixer disposed in the mixer body for mixing the wash water with the air guided through the air introduction part.

A washing machine according to the present invention includes a mixer body including an inlet body, into which wash water is introduced, and an outlet body, from which the wash water is discharged, an air introduction part formed in the mixer body for guiding air into the mixer body, and a mixer disposed between the inlet body and the outlet body for mixing the wash water with the air guided through the air introduction part, wherein the mixer includes a body part disposed in the mixer body, a plurality of mixer holes formed through the body part, a body support part formed at the body part, the body support part being supported by the mixer body, and a ring groove formed between the body part and the mixer body for guiding the air guided through the air introduction part so as to flow along the outside of the mixer body.

A washing machine according to the present invention includes a mixer body comprising an inlet body, into which wash water is introduced, and an outlet body, from which the wash water is discharged, an air introduction part formed in the mixer body for guiding air into the mixer body, a mixer disposed between the inlet body and the outlet body for mixing the wash water with the air guided through the air introduction part, and a vane member disposed in the mixer body for swirling wash water that flows, wherein the mixer includes a body part disposed in the mixer body, a plurality of mixer holes formed through the body part, a body support part formed at the body part, the body support part being supported by the mixer body, and a ring groove formed between the body part and the mixer body for guiding the air guided through the air introduction part so as to flow along an outside of the mixer body, and wherein the vane member includes a vane body fixed in the mixer body, a vane column located at the axial center of the mixer body and extending in a direction in which the wash water flows, and a vane configured to connect the vane column and the vane body and to provide rotational force to the wash water that flows.

A washing machine according to the present invention includes a cabinet that forms the external appearance thereof, a tub disposed in the cabinet for receiving wash water, a pump for circulating the wash water received in the tub, a circulation nozzle for spraying the wash water supplied from the pump into the tub, a circulation hose configured to connect the pump and the tub and to guide the wash water that is circulated to the circulation nozzle, and an atomizing unit disposed in the circulation hose for mixing the wash water that is circulated with air to atomize the wash water.

A washing machine according to the present invention includes a cabinet that forms the external appearance thereof, a tub disposed in the cabinet for receiving wash water, a pump for circulating the wash water received in the tub, a circulation nozzle for spraying the wash water supplied from the pump into the tub, a circulation hose configured to connect the pump and the tub and to guide the wash water that is circulated to the circulation nozzle, a water supply hose connected to an external water source for supplying wash water into the tub, a spray nozzle connected to the water supply hose for spraying the supplied wash water into the tub, and an atomizing unit disposed in the circulation hose for mixing the wash water that is circulated with air to atomize the wash water, wherein the atomizing unit includes an air pump for supplying air, a circulation air mixer disposed in the circulation hose for mixing the wash water that is circulated with the air supplied from the air pump, and a water supply air mixer mounted in the water supply hose for mixing the wash water supplied from the water supply valve with the air supplied from the air pump.

The details of other embodiments are included in the following description and the accompanying drawings.

Advantageous Effects

The present invention has one or more of the following effects.

First, wash water containing air is supplied through the air mixer, whereby it is possible to reduce the total amount of wash water that is used.

Second, the selection valve is provided, whereby it is possible to selectively supply air to any one selected from between the circulation air mixer and the water supply air mixer.

Third, air is injected during circulation of wash water, whereby it is possible to effectively dissolve detergent that has not been dissolved.

Fourth, wash water is swirled while passing through the air mixer, whereby it is possible to more actively dissolve detergent that remains in the wash water.

It should be noted that effects of the present invention are not limited to the effects of the present invention as mentioned above, and other unmentioned effects of the present invention will be clearly understood by those skilled in the art from the following claims.

BEST MODE

Figure 1:
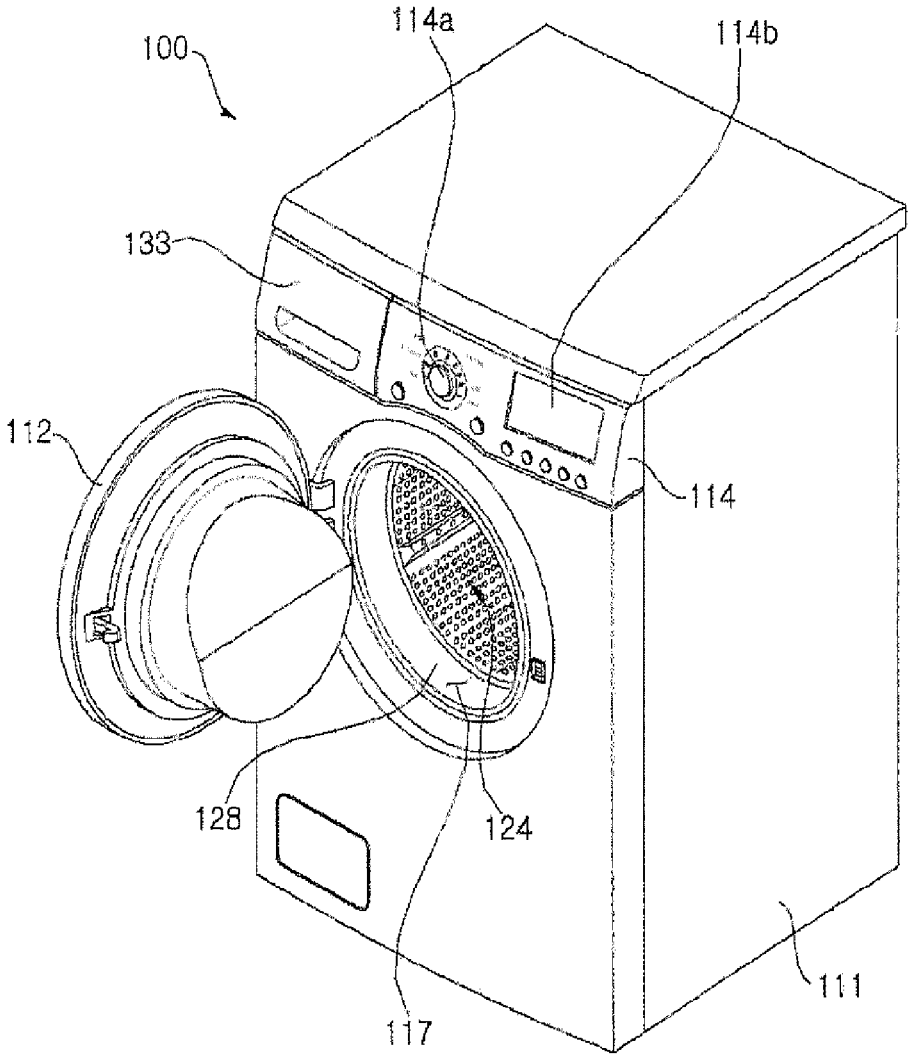
FIG. 1 is a perspective view showing a washing machine according to an embodiment of the present invention.
Figure 2:
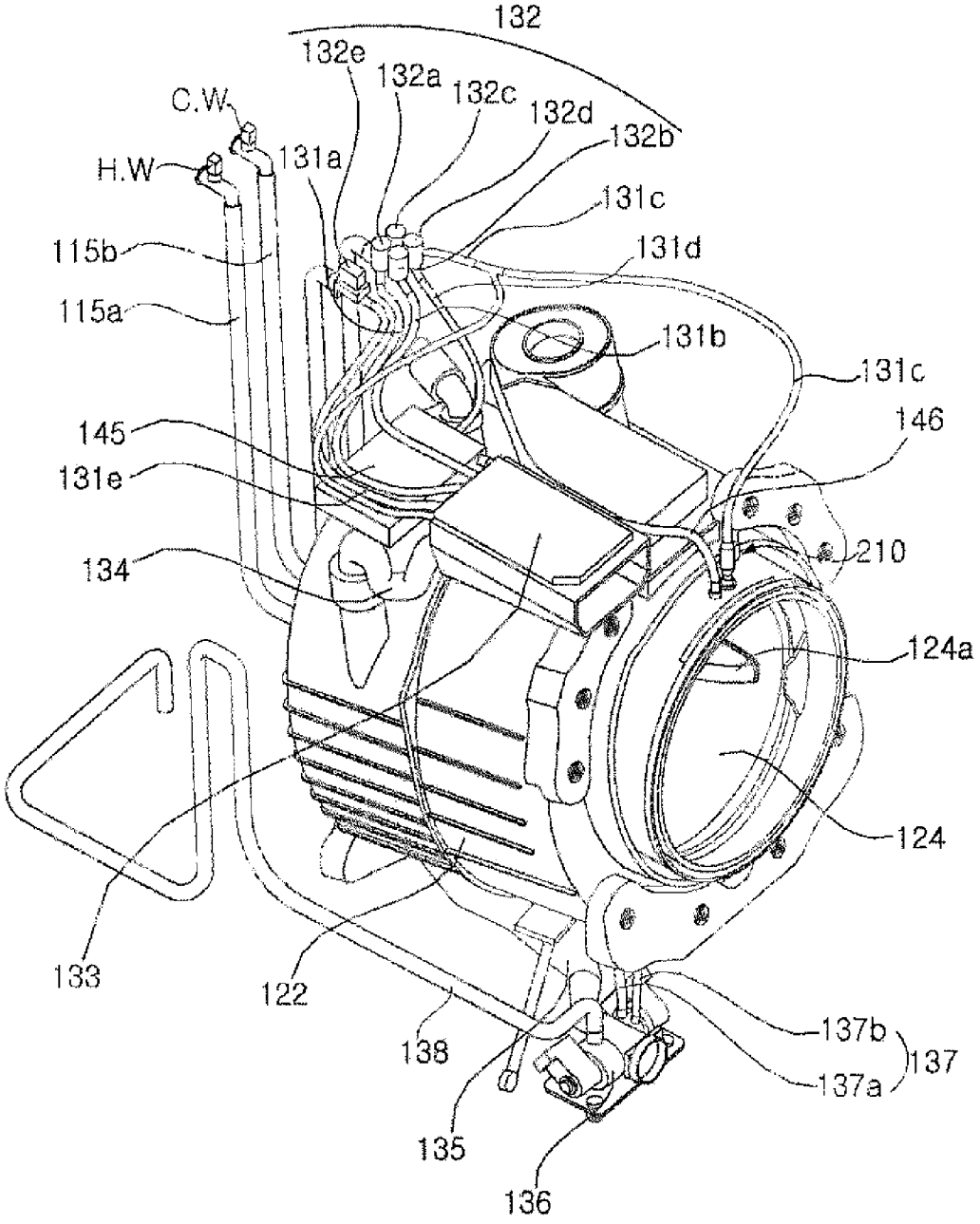
FIG. 2 is a perspective view showing the interior structure of the washing machine shown in FIG. 1.
Figure 3:
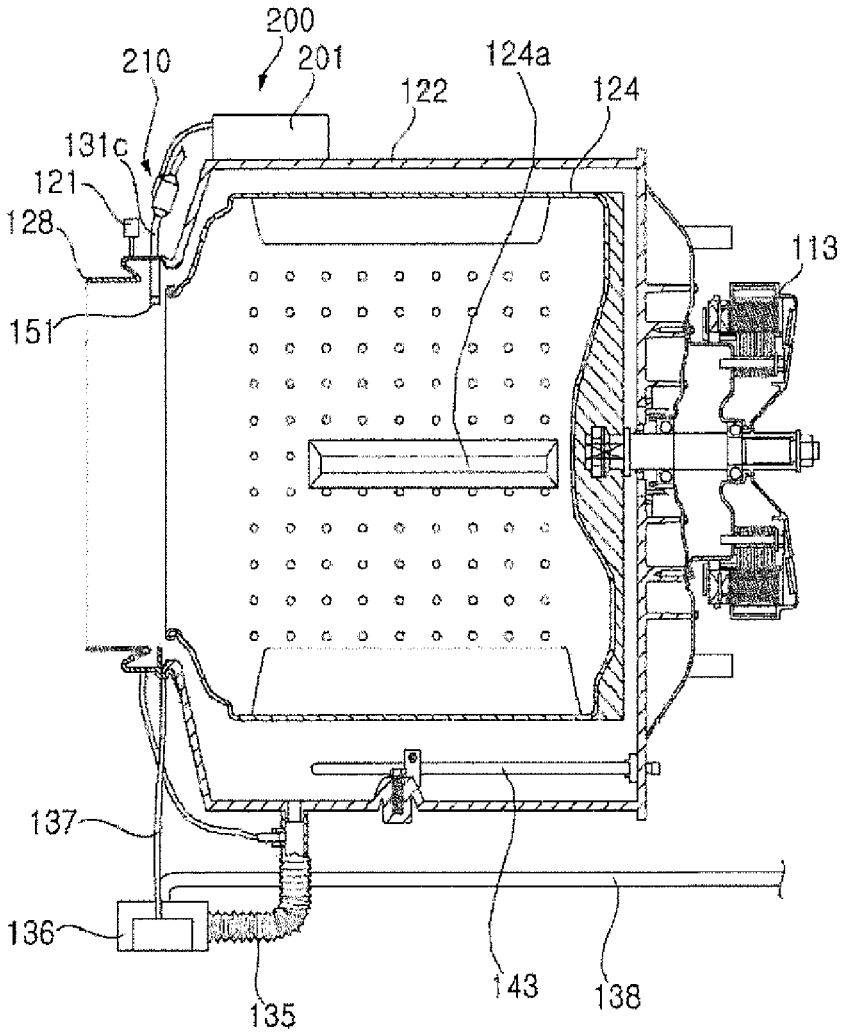
FIG. 3 is a sectional view showing the interior structure of the washing machine shown in FIG. 1.
Figure 4:
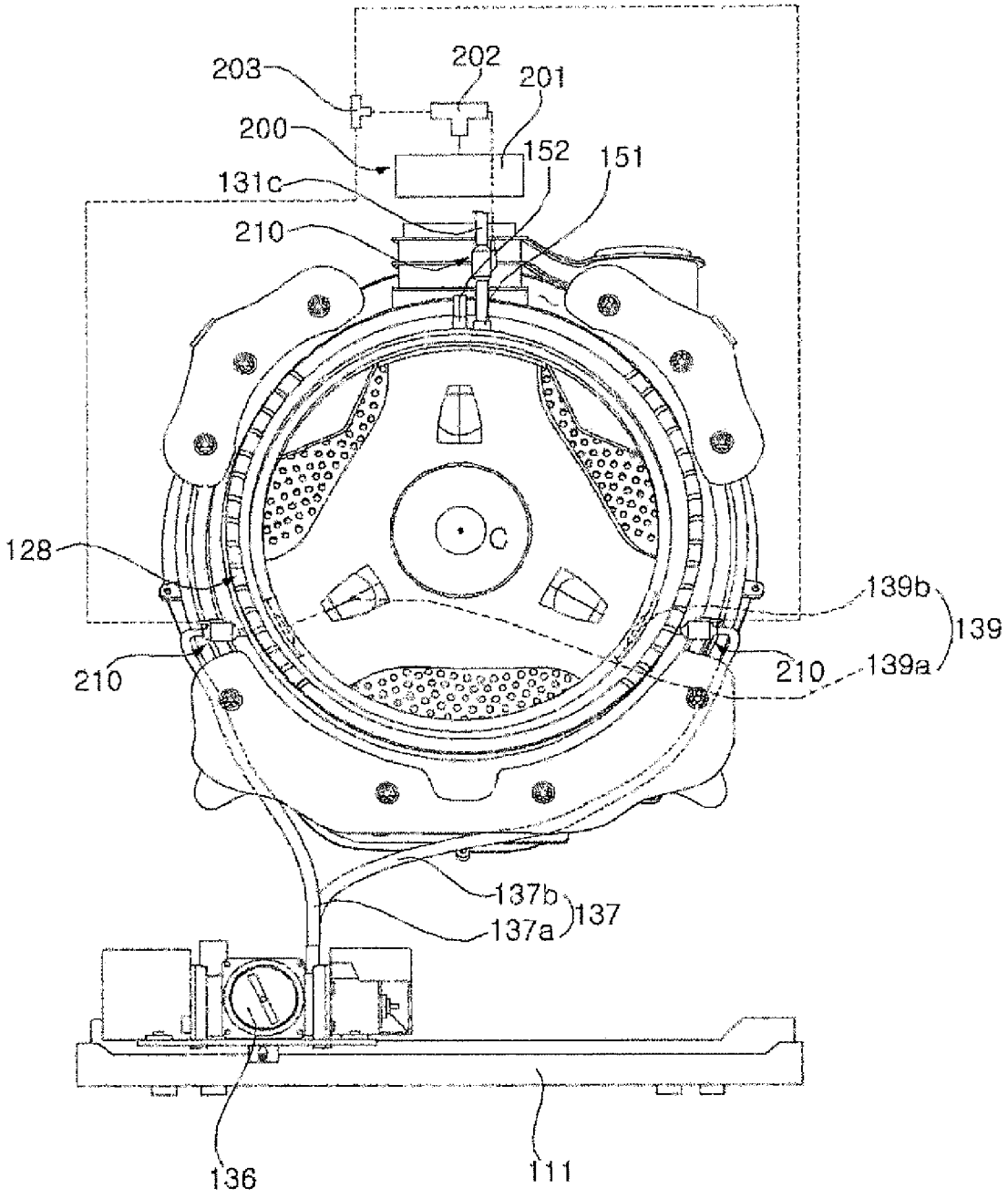
FIG. 4 is a front view showing the interior structure of the washing machine shown in FIG. 1.
Figure 5:
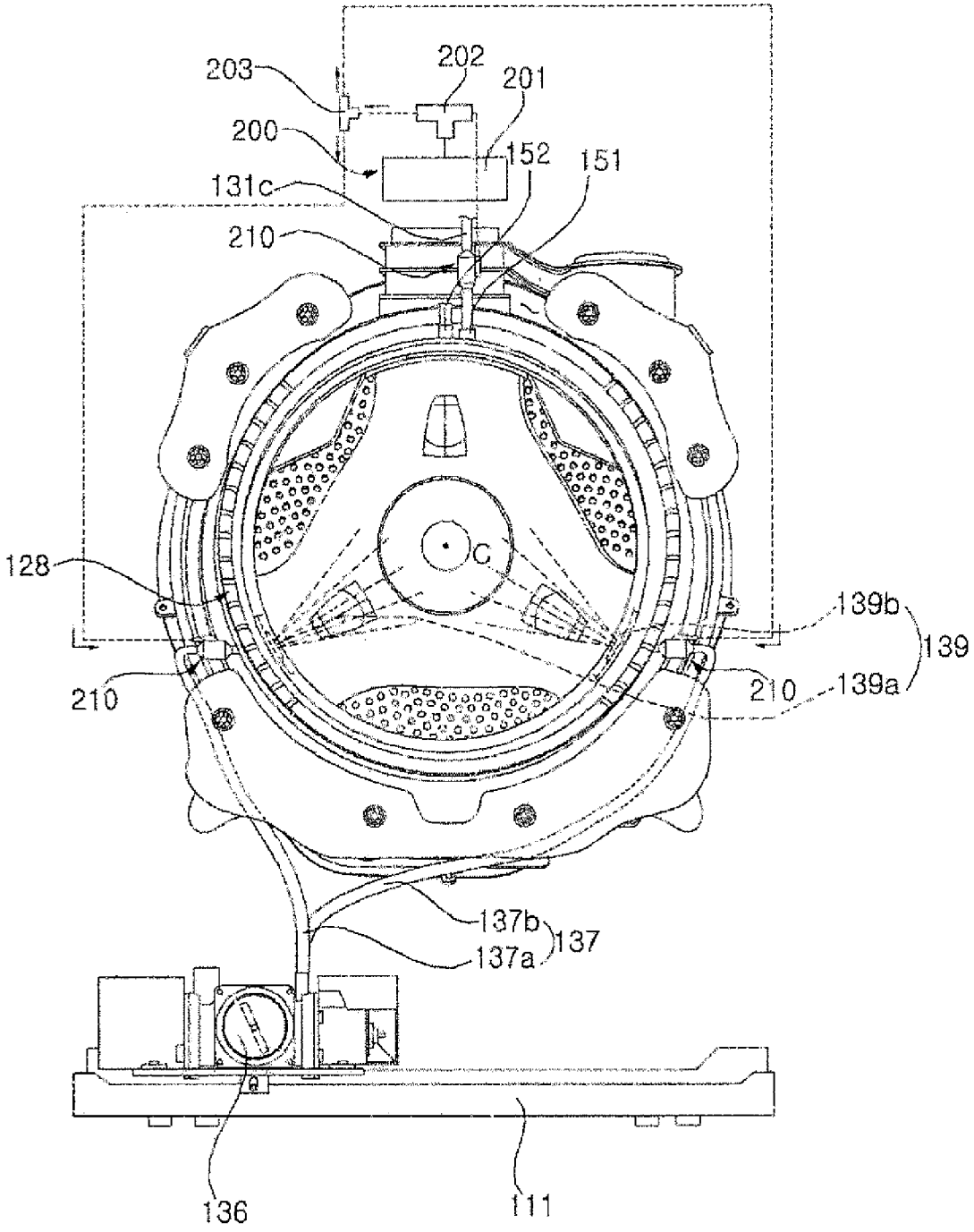
FIG. 5 is a first illustration view showing the operation process of an atomizing unit during a water supply process.
Figure 6:
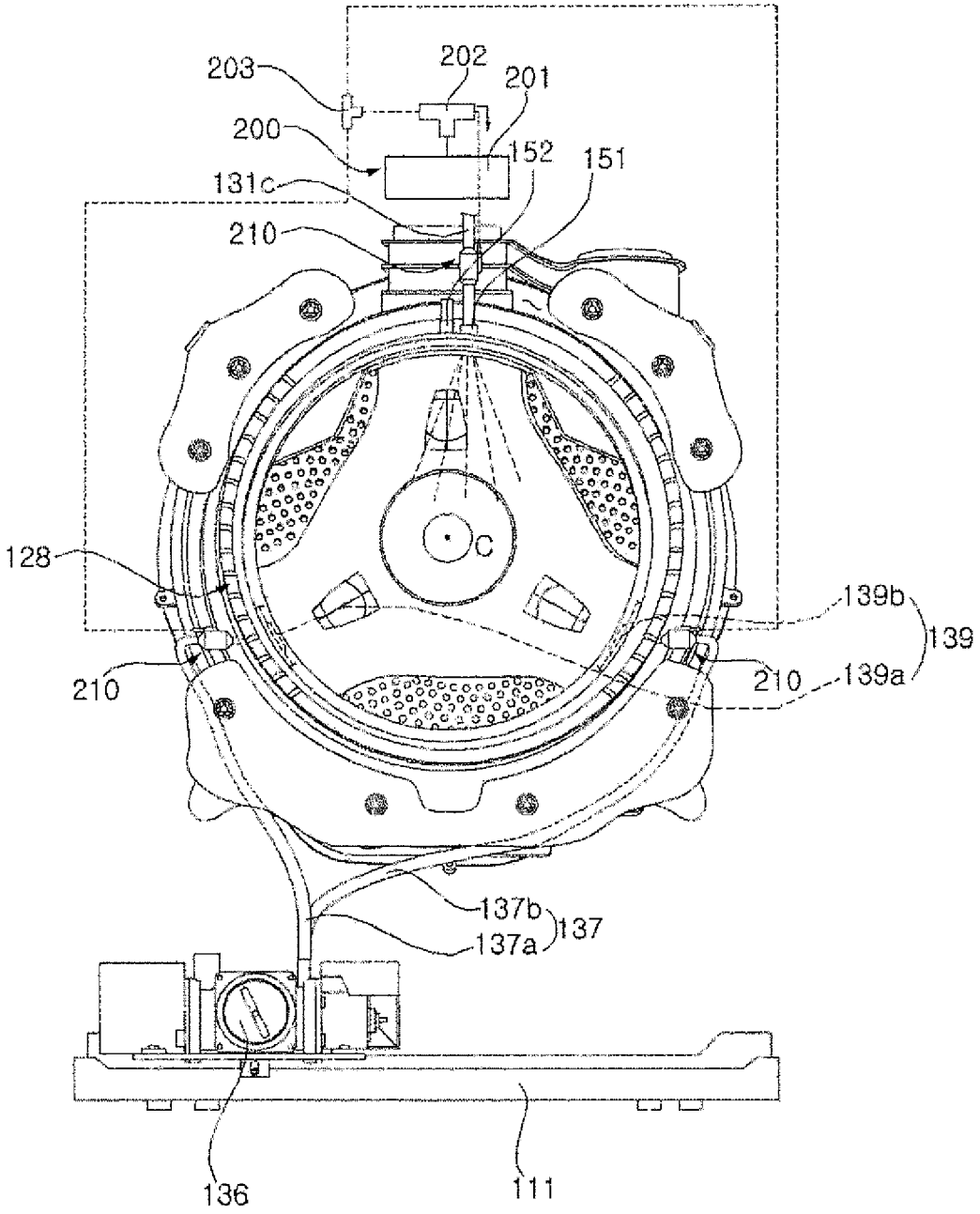
FIG. 6 is a first illustration view showing the operation process of the atomizing unit during a rinsing process or a spin-drying process.
Figure 7:
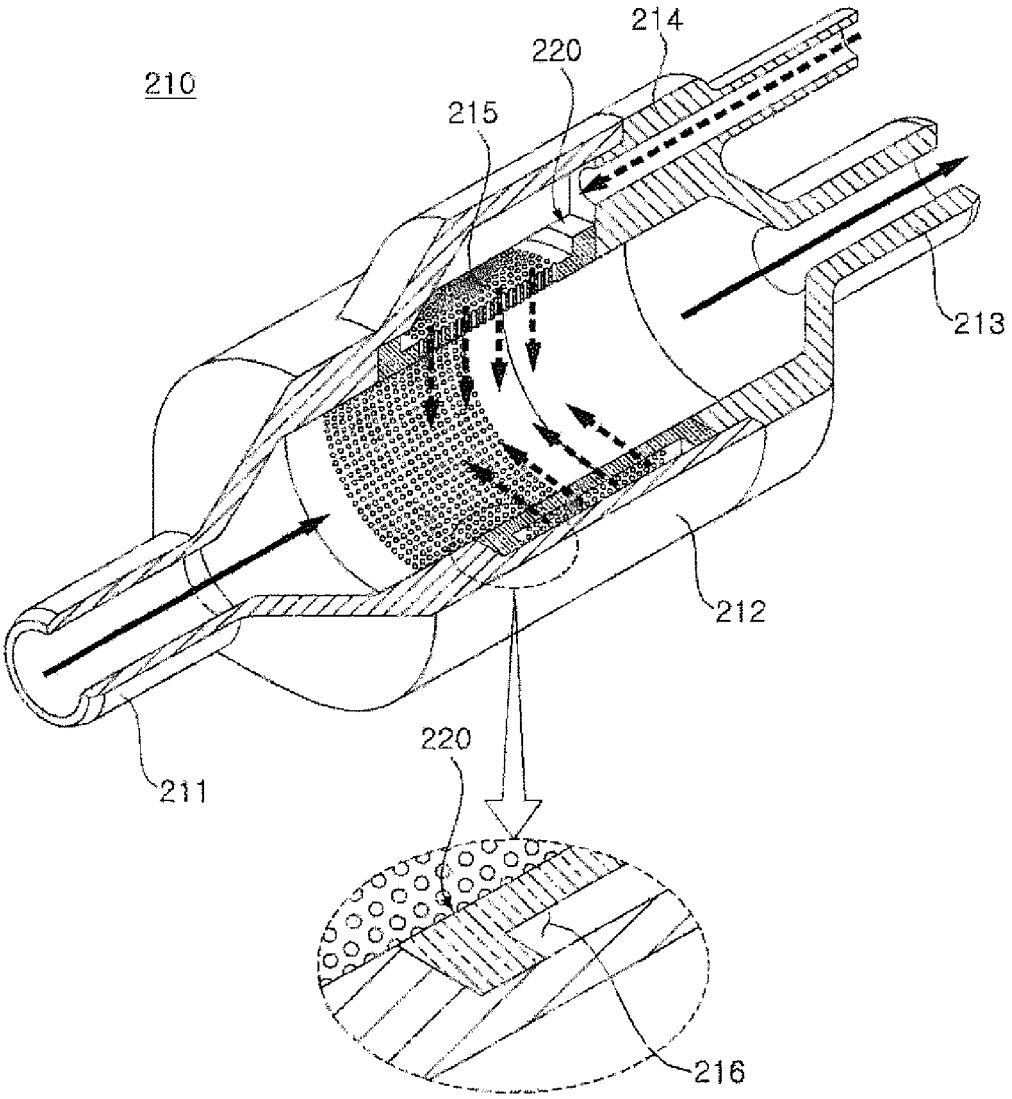
FIG. 7 is a partial cut-away perspective view of an air mixer shown in FIG. 4.
Figure 8:
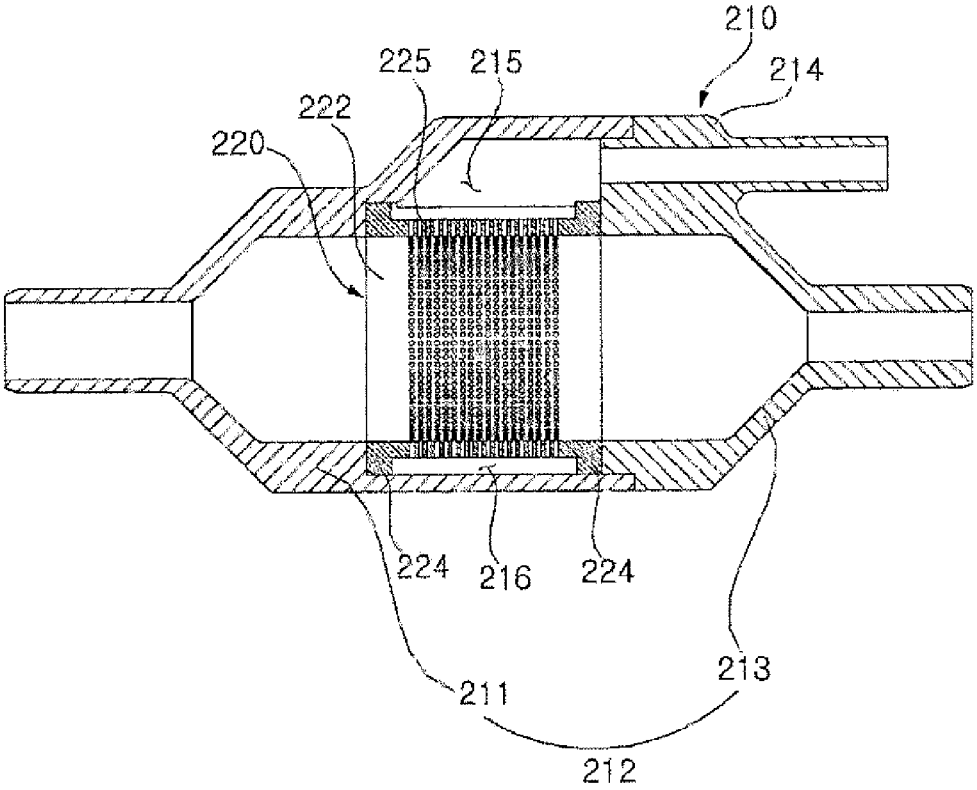
FIG. 8 is a front sectional view of the air mixer shown in FIG. 4.
Figure 9:
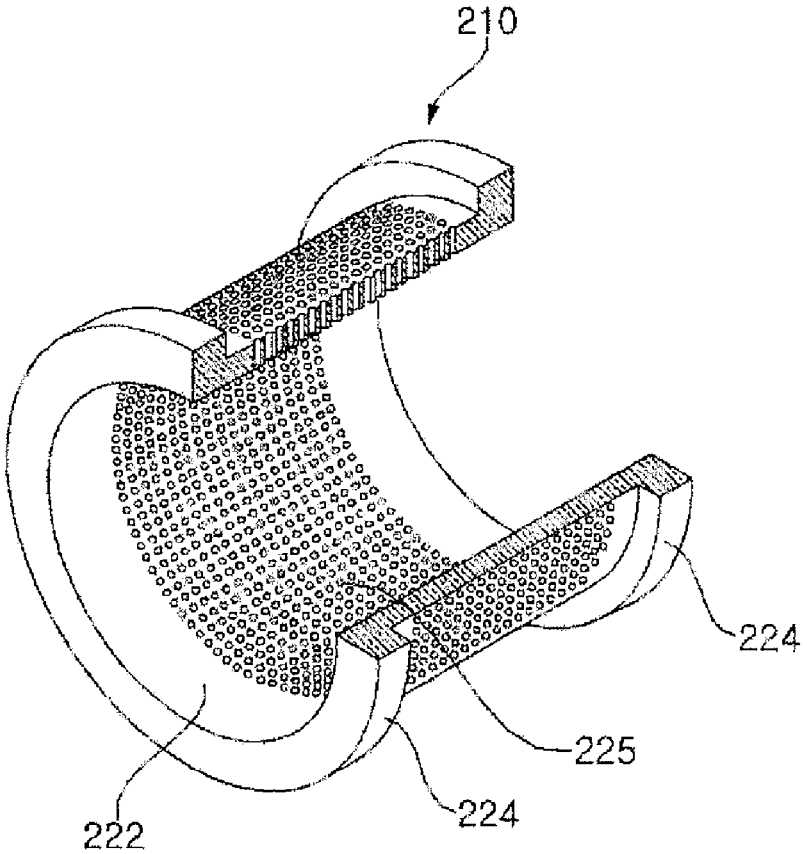
FIG. 9 is a partial cut-away perspective view of the mixer shown in FIG. 7.

The advantages and features of the present invention and the way of achieving them will become apparent with reference to embodiments described below in conjunction with the accompanying drawings. However, the present invention is not limited to embodiments disclosed in the following description but may be embodied in various different forms. The embodiments, which will be described below, of the present invention are provided to complete the disclosure of the present invention and to correctly inform those skilled in the art to which the present invention pertains of the scope of the invention. The present invention is defined only by the scope of the accompanying claims. Throughout the specification, the same components are denoted by the same reference numerals.

A washing machine according to an embodiment of the present invention will be described with reference to FIGS. 1 to 6.

A washing machine 100 according to this embodiment includes a cabinet 111 that forms the external appearance thereof, a tub 122 disposed in the cabinet 111 for receiving wash water, a drum 124 rotatably disposed in the tub 122, a drive unit 113 for rotating the drum 124, and a water supply unit 132 for receiving wash water from an external water source and supplying the received wash water to the tub 122.

The washing machine 100 according to this embodiment includes a detergent box 133 mounted in the cabinet 111 for receiving detergent and mixing the wash water supplied from the water supply unit 132 with the detergent, a spray nozzle 151 for spraying the wash water supplied from the water supply unit 132 into the drum 124, a pump 136 for discharging the wash water from the tub 122 and supplying the wash water back into the tub 122 to circulate the wash water, and a circulation nozzle 139 for spraying the wash water circulated by the pump 136 into the drum 124.

The cabinet 111 forms the external appearance of the washing machine 100. The tub 122 is provided in the cabinet 111. The cabinet 111 is provided with a laundry introduction hole 117, through which laundry is introduced and removed. At the front of the cabinet 111 is hingedly provided a door 112 for opening and closing the laundry introduction hole 117. The cabinet 111 is provided with a control panel 114 for allowing a user to input a command and displaying various kinds of information about the state of the washing machine 100. The detergent box 133, in which detergent, such as detergent, rinse, or decolorant, is received, is provided in the cabinet 111 such that the detergent box 133 can be withdrawn from the cabinet 111.

The tub 122 is suspended by a spring unit (not shown) and a damper (not shown), which are mounted in the cabinet 111.

The tub 122 receives wash water. The drum 124 is disposed in the tub 122. A portion of the drum 124 may be submerged in the wash water received in the tub 122.

The tub 122 may be provided with a water level sensor 121 for sensing the level of the wash water received in the tub 122. The water level sensor 121 may be variously configured. In this embodiment, the water level sensor 121 is configured to change the distance between electrodes using air pressure that varies based on the level of the wash water and to measure the level of the wash water based on capacitance variation of the electrodes. In the tub 122 may be provided a heater 143 for heating the wash water.

The drum 124, in which laundry is received, is configured to be rotatable. The drum 124 is provided with a plurality of through holes 124*b*, through which the wash water flows. At the inner wall of the drum 124 may be mounted a plurality of lifters 124*a* for lifting the laundry to a predetermined height during the rotation of the drum 124. The drum 124 is rotated using rotational force from the drive unit 113.

The drum 124 is not disposed in a completely horizontal state. The drum 124 may be disposed in the state of being inclined at a predetermined angle such that the rear part of the drum 124 is lower than the horizontal state of the drum 124.

A gasket 128 is provided between the tub 122 and the cabinet 111 to seal between the tub 122 and the cabinet 111. The gasket 128 is disposed between the inlet of the tub 122 and the laundry introduction hole 117. The gasket 128 eliminates impact applied to the door 112 during the rotation of the drum 124 and, at the same time, prevents the wash water received in the tub 122 from leaking outwards.

The gasket 128 may be made of a single material. Alternatively, in order to increase the intensity in fastening between the gasket 128 and the tub 122 and to improve the rigidity of the gasket 128, a part of the gasket 128 that is fastened to the tub 122 may be made of a hard material. In addition, a part of the gasket 128 that is fastened to the cabinet 111 may be made of an elastic material in order to eliminate vibration transferred from the tub 122 to the cabinet 111.

The gasket 128 is provided with a spray nozzle 151 for introducing wash water into the drum 124 and a steam nozzle 152 for spraying steam into the circulation nozzle 139 and the drum 124.

The drive unit 113 rotates the drum 124. The drive unit 113 may rotate the drum 124 at various rotational speeds or in various rotational directions. The drive unit 113 may include a motor, a switching element for controlling the motor, and a clutch. The drive unit 113 may include a sensor for measuring the actual rotational speed of the drum 124.

Detergent, such as detergent, rinse, or decolorant, is received in the detergent box 133. The detergent box 133 may be disposed in the front of the cabinet 111 such that the detergent box 133 can be withdrawn from the cabinet 111. When wash water is supplied, the detergent received in the detergent box 133 is mixed with the wash water, and the mixture is introduced into the tub 122. The detergent box 133 may be partitioned into a detergent receiving part, a rinse receiving part, and a decolorant receiving part.

The washing machine 100 is connected to a hot water source H.W, which is connected to the external water source to supply hot water to the washing machine 100, via a hot water hose 115*a*. In addition, the washing machine 100 is connected to a cold water source C.W, which is connected to the external water source to supply cold water to the washing machine 100, via a cold water hose 115*b*. Water introduced through the hot water hose 115*a* and the cold water hose 115*b* is supplied to the detergent box 133, a steam unit 145, and/or the spray nozzle 151 under appropriate control of the water supply unit 132.

In the cabinet 111 are provided the water supply unit 132, which is connected to the hot water hose 115*a* and the cold water hose 115*b* to control the introduction of wash water from the external water source, a first water supply hose 131*a* and a second water supply hose 131*b* connected to the water supply unit 132 for guiding the wash water supplied from the cold water source C.W to the detergent box 133 according to the operation of the water supply unit 132, and a third water supply hose 131*c* connected to the water supply unit 132 for guiding the wash water supplied from the cold water source C.W to the spray nozzle 151 and the detergent box 133 according to the operation of the water supply unit 132. The third water supply hose 131*c* diverges from the water supply unit 132, and is connected to the spray nozzle 151 and to the detergent box 133.

Additionally, in the cabinet 111 are provided a fourth water supply hose 131*d* connected to the water supply unit 132 for guiding the wash water supplied from the cold water source C.W to the steam unit 145 according to the operation of the water supply unit 132 and a fifth water supply hose 131*e* connected to the water supply unit 132 for guiding high-temperature wash water supplied from the hot water source H.W to the detergent box 133 according to the operation of the water supply unit 132.

In the cabinet 111 may be provided a water supply pipe 134, through which wash water mixed with the detergent in the detergent box 133 is introduced into the tub 122.

The water supply unit 132 includes a preliminary valve 132*a* connected to the first water supply hose 131*a*, a main valve 132*b* connected to the second water supply hose 131*b*, a bleach valve 132*c* connected to the third water supply hose 131*c*, a steam valve 132*d* connected to the fourth water supply hose 131*d*, and a hot water valve 132*e* connected to the fifth water supply hose 131*e* for controlling the introduction of high-temperature wash water.

When the preliminary valve 132*a* is opened, wash water is supplied to the detergent box 133 through the second water supply hose 131*b*. The wash water supplied at the result of opening of the preliminary valve 132*a* passes through the detergent receiving part of the detergent box 133. The wash water is mixed with detergent for preliminary washing, and the mixture is supplied into the tub 122 through the water supply pipe 134. If no detergent for preliminary washing is provided, the wash water supplied at the result of opening of the preliminary valve 132*a* is supplied into the tub 122 through the water supply pipe 134 in the state in which no detergent for preliminary washing is mixed with the wash water.

When the main valve 132*b* is opened, wash water is supplied to the detergent box 133 through the second water supply hose 131*b*. The wash water supplied at the result of opening of the main valve 132*b* passes through the detergent receiving part of the detergent box 133. The wash water is mixed with the detergent, and the mixture is supplied into the tub 122 through the water supply pipe 134.

When the bleach valve 132*c* is opened, wash water is supplied to the spray nozzle 151 and the detergent box 133 through the third water supply hose 131*c*. A portion of the wash water supplied at the result of opening of the bleach valve 132*c* is sprayed into the drum 124 through the spray nozzle 151. Another portion of the wash water supplied at the result of opening of the bleach valve 132*c* is mixed with the decolorant in the detergent box 133, and the mixture is supplied into the tub 122 through the water supply pipe 134.

If no decolorant is provided, the wash water supplied at the result of opening of the bleach valve 132*c* is supplied into the tub 122 through the water supply pipe 134 in the state in which no decolorant is mixed with the wash water.

When the steam valve 132*d* is opened, wash water is supplied to the steam unit 145 through the fourth water supply hose 131*d*. The wash water supplied at the result of opening of the steam valve 132*d* is heated into steam by the steam unit 145. The steam generated by the steam unit 145 is supplied to the steam nozzle 152 through a steam hose 146, and is sprayed into the drum 124 through the steam nozzle 152.

When the hot water valve 132*e* is opened, high-temperature wash water is supplied to the detergent box 133 through the fifth water supply hose 131*e*. The wash water supplied at the result of opening of the hot water valve 132*e* passes through the detergent box 133, and is supplied into the tub 122 through the water supply pipe 134.

In the cabinet 111 are provided a drainage pipe 135, through which the wash water is discharged from the tub 122, the pump 136, which discharges the wash water from the tub 122, a circulation hose 137 connected to the circulation nozzle 139 such that the wash water is circulated and is sprayed into the drum 124, and a drainage hose 138, through which the wash water is drained to the outside.

The pump 136 is configured to discharge the wash water from the tub 122.

The wash water that has moved to the pump 136 through the drainage pipe 135 is drained to the outside through the drainage hose 138, or is supplied into the tub 122 through the circulation hose 137. According to embodiments, the pump 136 may include a circulation pump and a drainage pump, which may be connected to the circulation hose 137 and the drainage hose 138, respectively.

The circulation hose 137 connects the pump 136 with the circulation nozzle 139. The wash water discharged from the tub 122 as the result of operation of the pump 136 pass through the circulation hose 137, and is then sprayed into the drum 124 through the circulation nozzle 139.

The control panel 114 may be provided with an input unit 114*b* for allowing a user to select washing courses or to input various kinds of operation commands, such as operation time for each cycle and scheduled operations, and a display unit 114*a* for displaying an operation state of the washing machine 100.

The washing courses may include a normal course, a lingerie/wool course, a boiling course, a speed wash course, a functional clothing course, a laundry damage prevention course, a silent course, and an energy saving course, which are classified based on the kind or function of laundry. The operation of the washing machine 100 is classified into a washing cycle, a rinsing cycle, and a spin-drying cycle. In each cycle, a water supply step, a washing step, a rinsing step, a drainage step, a spin-drying step, or a drying step is performed.

The spray nozzle 151 is provided in the gasket 128 to spray wash water into the drum 124. The spray nozzle 151 is disposed adjacent to the steam nozzle 152. The spray nozzle 151 is connected to the third water supply hose 131*c* to spray the wash water supplied from the external water source into the drum 124.

The spray nozzle 151 may be provided in the upper part of the gasket 128. According to embodiments, the spray nozzle 151 may be disposed at various positions. For example, the spray nozzle 151 may be disposed in the lower part of the gasket 128, between the gasket 128 and the cabinet 111, in the cabinet 111, or in the tub 122.

The spray nozzle 151 may be an atomizing nozzle, which atomizes wash water and sprays the atomized wash water to the side surface and the rear surface of the drum 124.

The steam nozzle 152 is provided in the gasket 128 to spray steam into the drum 124. The steam nozzle 152 is connected to the steam hose 146 to spray the steam generated by the steam unit 145 into the drum 124.

The steam nozzle 152 may be disposed in the upper part of the gasket 128. The steam nozzle 152 may be disposed adjacent to the spray nozzle 151. According to embodiments, the steam nozzle 152 may be disposed at various positions. For example, the steam nozzle 152 may be disposed in the lower part of the gasket 128, between the gasket 128 and the cabinet 111, in the cabinet 111, or in the tub 122.

The circulation nozzle 139 is provided in the gasket 128. The wash water circulated as the result of operation of the pump 136 is sprayed into the drum 124 through the circulation nozzle 139. The circulation hose 137 connects the circulation nozzle 139 and the pump 136. The water pumped out as the result of operation of the pump 136 passes through the circulation hose 137, and is then sprayed through the circulation nozzle 139. The circulation nozzle 139 may be formed integrally with the gasket 128.

The circulation nozzle 139 may be provided lower than a rotary shaft of the drum 124 such that wash water can be sprayed upward. A plurality of circulation nozzles 139 may be provided. In this embodiment, two circulation nozzles are provided in the gasket 128.

A first circulation nozzle 139*a* is provided in the lower left part of the gasket 128 to spray wash water in the rightward and upward direction toward the interior of the drum 124.

A second circulation nozzle 139*b* is provided in the lower right part of the gasket 128 to spray wash water in the leftward and upward direction toward the interior of the drum 124.

In the case in which a plurality of circulation nozzles 139 is provided, a plurality of circulation hoses 137 is also provided. A first circulation hose 137*a* may be connected to the first circulation nozzle 139*a*, and a second circulation hose 137*b* may be connected to the second circulation nozzle 139*b*.

The wash water received in the drum 124 moves to the pump 136 along the drainage pipe 135, which is provided in the tub 122. The wash water pumped out as the result of operation of the pump 136 flows to the circulation nozzle 139 through the circulation hose 137. Subsequently, the wash water is sprayed into the drum 124 through the circulation nozzle 139.

In order to spray the wash water into the drum 124, the circulation nozzles 139 may be disposed in the vicinity of the laundry introduction hole 117.

In this embodiment, an atomizing unit 200 is provided to atomize wash water to be sprayed into the tub 122.

The atomizing unit 200 performs an atomizing function of mixing wash water with air.

The performs atomizing to includes air mixers 210 provided in hoses in which wash water flows and an air pump 201 for supplying air to the air mixers 210.

In this embodiment, the air mixer atomizing unit 200 injects air into wash water to be sprayed through the spray nozzle 151 and the circulation nozzle 139 to atomize the wash water. To this end, the air mixers 210 are mounted in the third water supply hose 131*c* and the first and second circulation hoses 137*a* and 137*b*.

The air mixer 210 mounted in the first and second circulation hoses 137*a* and 137*b* is defined as a circulation air mixer, and the air mixer mounted in the third water supply hose 131*c* is defined as a water supply air mixer. The circulation air mixer and the water supply air mixer are identical in construction to each other, but different names are given thereto for the convenience of description.

The air mixers 210 may be mounted adjacent to the spray nozzle 151 and the circulation nozzle 139, and may rapidly spray atomized wash water.

Unlike this embodiment, an air mixer 210 may be mounted in at least one of the hoses 131*a*, 131*b*, 131*c*, 131*d*, and 131*e*.

Air from the air pump 201 may be supplied to the third water supply hose 131*c*. Air from the air pump 201 may be supplied to the first and second circulation hoses 137*a* and 137*b*.

For example, during a water supply cycle, the air from the air pump 201 may be supplied to the water supply air mixer 210 via the third water supply hose 131*c*.

In addition, during a washing or rinsing cycle, the air from the air pump 201 may be supplied to the circulation air mixer 210 via the first and second circulation hoses 137*a* and 137*b*.

To this end, a selection valve 202 is provided to change the flow direction of the air discharged from the air pump 201. The selection valve 202 is connected to the third water supply hose 131*c* and to the first and second circulation hoses 137*a* and 137*b*.

The selection valve 202 may select at least one selected from between the third water supply hose 131*c* and the first and second circulation hoses 137*a* and 137*b* in order to provide air.

In this embodiment, a three-way valve is used as the selection valve 202.

In this embodiment, a branch pipe 203 is further provided to guide air that has flown to the circulation hose 137 through the selection valve 202 to the first and second circulation hoses 137*a* and 137*b*.

Unlike this embodiment, the first and second circulation hoses 137*a* and 137*b* may be connected to the selection valve 202, and opening and closing valves (not shown) may be provided to individually open and close the first and second circulation hoses 137*a* and 137*b*.

Each air mixer 210 includes a mixer body 212, in which wash water flows, an air introduction part 214 formed in the mixer body 212 for allowing air to be supplied into the mixer body 212 therethrough, and a mixer 220 disposed in the mixer body 212 for mixing the wash water with the air introduced through the air introduction part 214.

The mixer body 212 extends in the direction in which the wash water flows.

In this embodiment, the mixer body 212 is formed by manufacturing and assembling two parts. The mixer body 212 includes an inlet body 211, into which wash water is introduced, and an outlet body 213, from which the wash water is discharged.

The mixer 220 is disposed between the inlet body 211 and the outlet body 213. At least a portion of the mixer 220 may overlap with at least one selected from between the inlet body 211 and the outlet body 213.

The mixer body 212 has therein a connection part 215, which is connected to the air introduction part 214. The connection part 215 may be disposed at various positions. In this embodiment, the connection part 215 is disposed between the inlet body 211 and the outlet body 213.

The air introduction part 214 may be formed in various directions. In this embodiment, the air introduction part 214 is formed so as to be parallel to the longitudinal direction of the mixer body 212.

In this embodiment, air supplied through the air introduction part 214 flows in the direction opposite the direction in which the wash water flows. In this embodiment, air supplied through the air introduction part 214 flows from the outlet body 213 to the inlet body 211, and the flow direction of the air is changed in the connection part 215.

Unlike this embodiment, the air introduction part 215 may flow in the same direction as the direction in which wash water flows, and may be mixed with the wash water.

In this embodiment, the air introduction part 214 is integrally formed with the outlet body 213. Unlike this embodiment, the air introduction part 214 may be integrally formed with the inlet body 211. Air introduction parts 214 may be provided in the inlet body 211 and the outlet body 213, and may be coupled to each other in order to completely perform the function thereof.

The air that has passed through the connection part 215 is mixed with wash water in the mixer body 212. The flow directions of the air and the wash water intersect each other. In this embodiment, the flow direction of the air is perpendicular to the flow direction of the wash water.

The connection part 215 is formed in the mixer body 212 in the radial direction of the mixer body 212.

The mixer body 212 is provided therein with a ring groove 216 extending in the radial direction thereof.

The connection part 215 is connected to at least a portion of the ring groove 216. Air introduced through the connection part 215 may flow along the ring groove 216.

The ring groove 216 may be formed in at least one selected from between the inlet body 211 and the outlet body 213. In this embodiment, the ring groove 216 is formed between the inlet body 211 and the outlet body 213.

The flow direction of the air that has flown through the air introduction part 214 is changed in the connection part 215. Some of the air supplied to the connection part 215 may be discharged into the mixer body 212, and the remainder may flow along the ring groove 216.

The mixer 220 may be mounted at only a portion of the connection part 215. In this embodiment, the mixer 220 may be formed to cover the entirety of the ring groove 216.

The air that has flown to the air introduction part 214 and the ring groove 216 passes through the mixer 220. When passing through the mixer 220, the air is sprayed toward the axial center of the mixer body 212.

The mixer 220 includes a cylindrical body part 222, a plurality of mixer holes 225 formed through the body part 222, and a body support part 224 formed at the body part 222 so as to be spaced apart from the mixer body 212 by a predetermined distance for defining the ring groove 216.

The body part 222 may be formed in various shapes. In this embodiment, the body part 222 is formed in a cylindrical shape.

The mixer holes 225 are formed in the axial direction of the air mixer 210.

The mixer holes 225 may be formed so as to face the interior of the body part 222.

In this embodiment, the mixer holes 225 are formed uniformly in the entirety of the body part 222. Unlike this embodiment, the mixer holes 225 may be formed in only a portion of the body part 222. In particular, the mixer holes 225 may be formed in only a region of the body that abuts the air introduction part 214. The mixer holes 225 may be formed in the surface of the body that contacts the ring groove 216.

The body support part 224 is provided to form at least a portion of the ring groove 216. The body support part 224 may not be provided depending on the shape of the mixer body 212.

For example, the inner surface of the mixer body 212 may be formed so as to protrude toward the mixer 220. In the case in which the mixer body is formed so as to be spaced apart from the mixer 220 by a predetermined distance, the body support part 224 may be omitted.

The body support part 224 may be bent outside in the radial direction, and the ring groove 216 may be formed between the body part 222 and the inner surface of the mixer body 212.

In the air mixers 210 according to this embodiment, wash water containing air is supplied into the tub 122. Consequently, it is possible to reduce the total amount of wash water that is used.

In the air mixers 210 according to this embodiment, air is contained in wash water. Consequently, the wash water may be sprayed through the circulation nozzle 139 or the spray nozzle 151 at a wide spray angle. The wide spray angle helps laundry to be effectively wetted.

In the circulation air mixer 210 according to this embodiment, air is injected during circulation of wash water. Consequently, it is possible to more effectively dissolve detergent remaining in the wash water without being dissolved.

Figure 10:
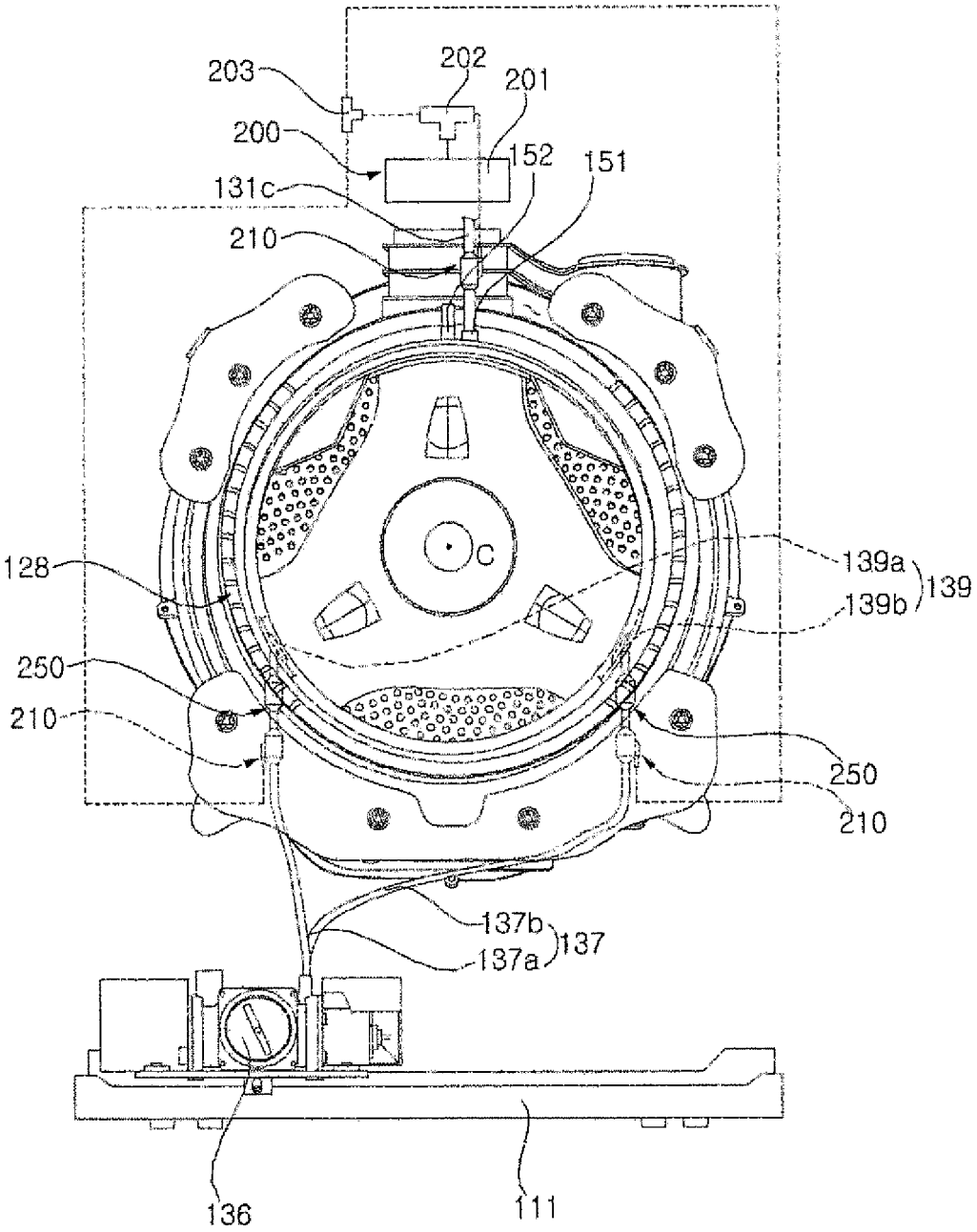
FIG. 10 is a front view showing the interior structure of a washing machine according to a second embodiment of the present invention.
Figure 11:
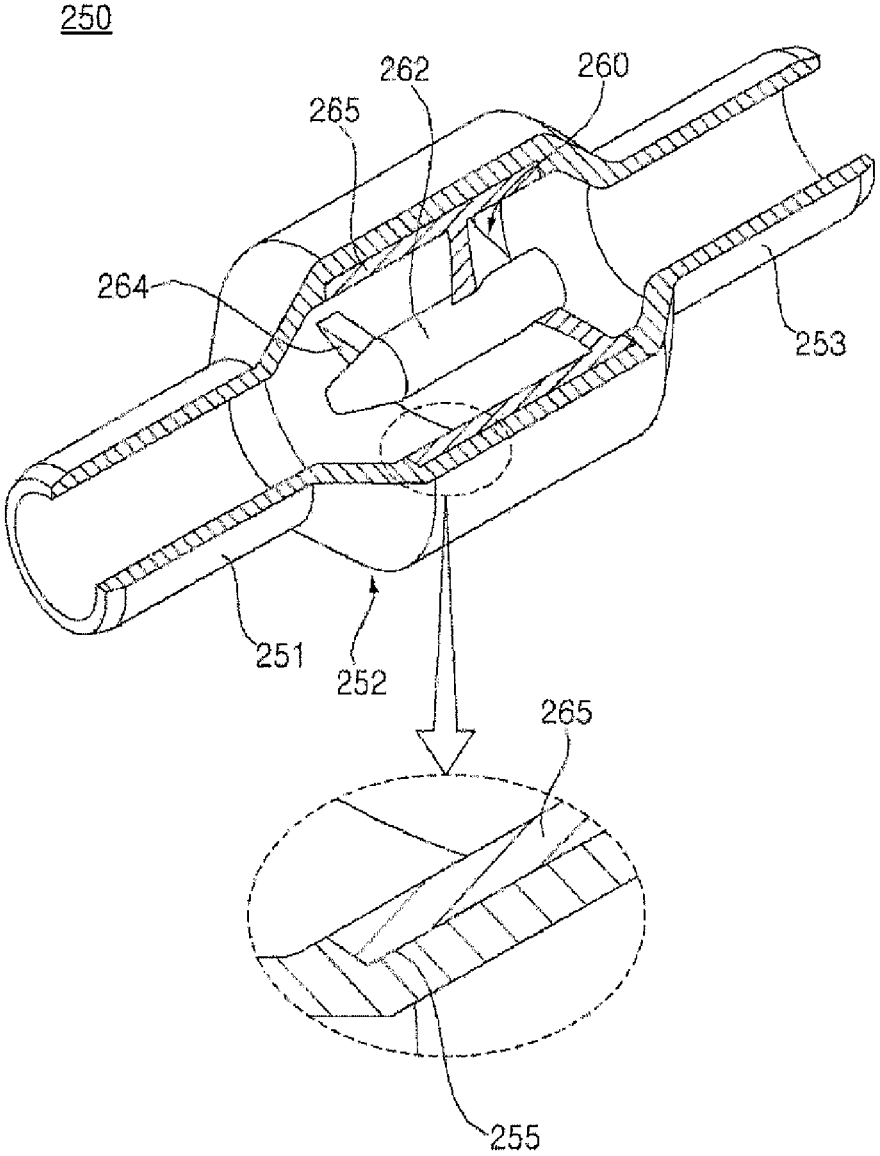
FIG. 11 is a partial cut-away perspective view of a swirling activator shown in FIG. 10.
Figure 12:
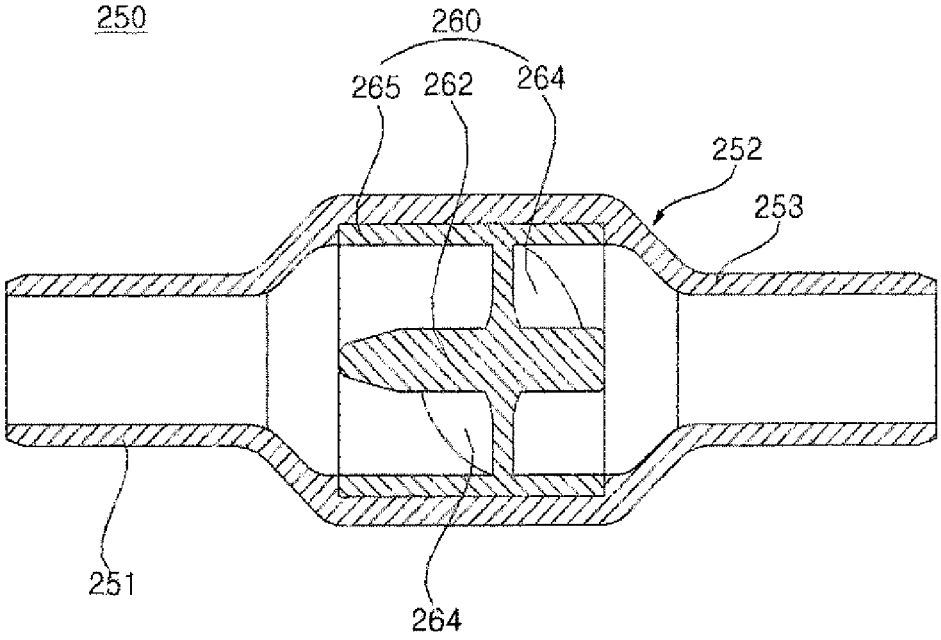
FIG. 12 is a front sectional view of the swirling activator shown in FIG. 10.

FIG. 10 is a front view showing the interior structure of a washing machine according to a second embodiment of the present invention, FIG. 11 is a partial cut-away perspective view of a swirling activator shown in FIG. 10, and FIG. 12 is a front view of the swirling activator shown in FIG. 10.

An atomizing unit 200 of the washing machine according to this embodiment further includes a swirling activator 250 for swirling wash water.

The swirling activator 250 swirls wash water in the direction in which the wash water flows.

In this embodiment, the swirling activator 250 is disposed between an air mixer 210 and a circulation nozzle 139.

The swirling activator 250 provides rotational force in the direction in which the wash water flows. The swirling activator 250 may maximize mixing of wash water and air supplied from the air mixer 210.

The swirling activator 250 swirls wash water in the direction in which the wash water flows.

The wash water swirled by the swirling activator 250 may more effectively dissolve the remaining detergent.

In this embodiment, the wash water that has passed through the swirling activator 250 is provided to the circulation nozzle 139. The wash water swirled by the swirling activator 250 may enlarge the spray area of the circulation nozzle 139.

Unlike this embodiment, the swirling activator 250 may be mounted in a third water supply hose 131*c*, and the wash water that has passed through the swirling activator 250 may be provided to a spray nozzle 151.

The swirling activator 250 includes a swirling body 252 and a vane member 260 disposed in the swirling body 252 for generating rotational force due to friction with wash water that flows.

In this embodiment, the swirling body 252 includes two parts: an inlet swirling body 251 and an outlet swirling body 253.

The vane member 260 is disposed between the inlet swirling body 251 and the outlet swirling body 253.

At least one selected from between the inlet swirling body 251 and the outlet swirling body 253 is provided with a vane fixing part 255, to which the vane member 260 is fixed.

In this embodiment, the vane fixing part 255 is formed in the inner surfaces of the inlet swirling body 251 and the outlet swirling body 253 in a groove shape.

The vane fixing part 255 is formed along the inner surface of the vane member 260 in a circular shape. Unlike this embodiment, the vane fixing part 255 may be formed in only a portion of the swirling body 252.

The vane member 260 includes a vane body 265 configured to be inserted and fixed into the vane fixing part 255, a vane column 262 located at the axial center of the swirling body 252 and extending in the direction in which the wash water flows, and a vane 264 connecting the vane column 262 and the vane body 265.

In this embodiment, two vanes 264 are provided, and are formed in a spiral shape to connect the vane column 262 and the vane body 265. The vanes 264 may be disposed around the vane column 262 at an interval of 180 degrees.

The front side (i.e. the inlet swirling body) of the vane column 262 may be formed in a conical shape to reduce resistance to wash water.

Meanwhile, in this embodiment, the swirling activator 250 and the air mixer 210 are disposed in the vertical direction.

In the case in which the swirling activator 250 and the air mixer 210 are disposed in the vertical direction, as in this embodiment, wash water does not remain in the swirling activator 250 and the air mixer 210 and moves downward by weight so as to be removed even when a pump 136 is stopped.

The other construction of the second embodiment is identical to that of the first embodiment, and therefore a detailed description thereof will be omitted.

Figure 13:
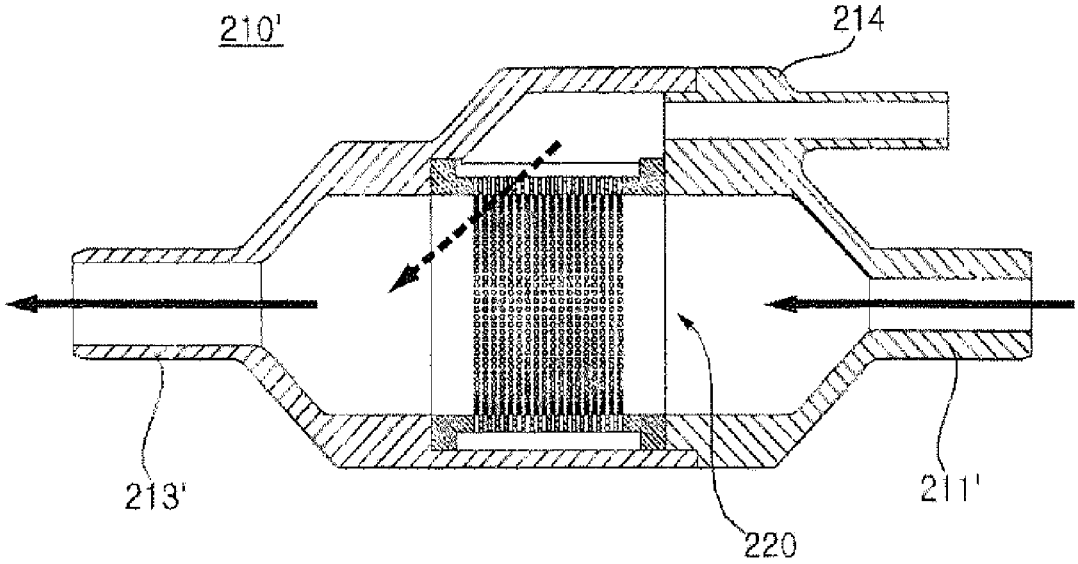
FIG. 13 is a front sectional view showing an air mixer according to a third embodiment of the present invention.

FIG. 13 is a front sectional view showing an air mixer according to a third embodiment of the present invention.

An air mixer 210' according to this embodiment is configured such that the flow direction of air introduced through an air introduction part 214' is parallel to the flow direction of wash water, unlike the first embodiment.

In this embodiment, therefore, the inlet body 211 of the first embodiment is used as an outlet body 213'.

Additionally, in this embodiment, therefore, the outlet body 213 of the first embodiment is used as an inlet body 211'.

Consequently, the air introduction part 214' is integrally formed with the inlet body 211'.

Since the flow direction of wash water is identical to the flow direction of air, as described above, it is possible to reduce flow resistance of the wash water to the air.

The other construction of the second embodiment is identical to that of the first embodiment, and therefore a detailed description thereof will be omitted.

Figure 14:
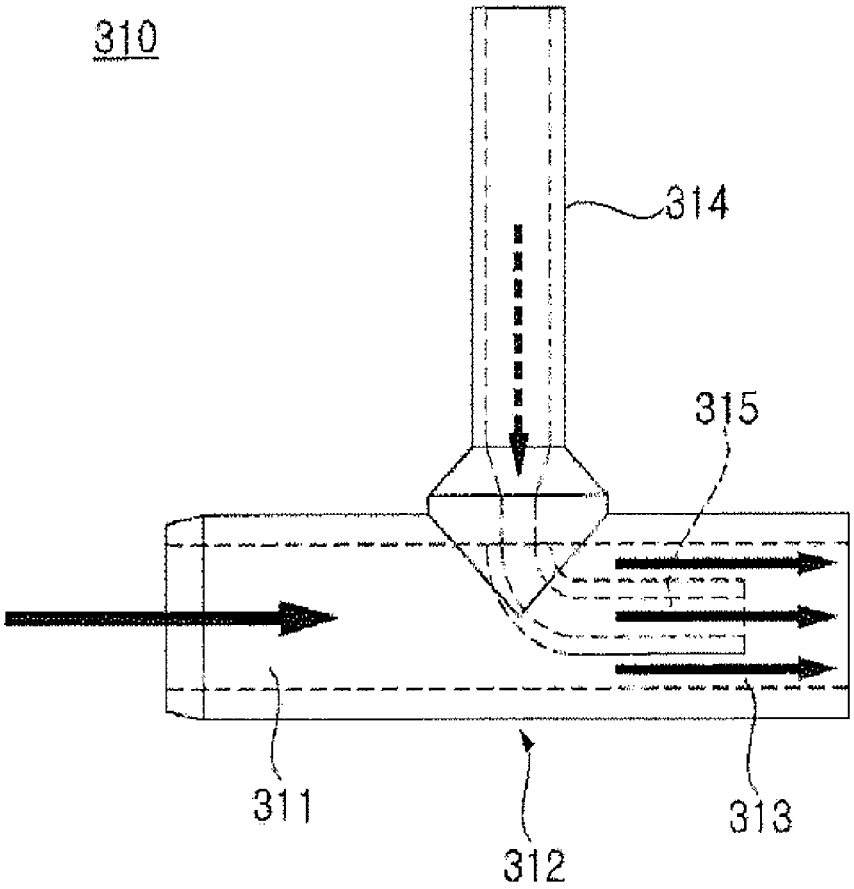
FIG. 14 is a front sectional view showing an air mixer according to a fourth embodiment of the present invention.

FIG. 14 is a front sectional view showing an air mixer according to a fourth embodiment of the present invention An air mixer 310 according to this embodiment is disposed such that the direction in which air is introduced is perpendicular to the flow direction of wash water.

The air mixer 310 includes a mixer body 312, in which wash water flows, and an air introduction part 314 for supplying air into the mixer body 312.

The mixer body 312 includes an inlet body 311 and an outlet body 313. The inlet body 311 and the outlet body 313 are disposed in a straight line. The air introduction part 314 is perpendicular to the mixer body 312.

Even in the case in which the air introduction part 314 and the mixer body 312 intersect each other, it is possible to sufficiently perform the function thereof.

Meanwhile, the air introduction part 314 is further provided with an extension part 315 extending into the mixer body 312. The extension part 315 may be bent from the air introduction part 314 in the direction in which the wash water flows.

The other construction of the second embodiment is identical to that of the first embodiment, and therefore a detailed description thereof will be omitted.

Figure 15:
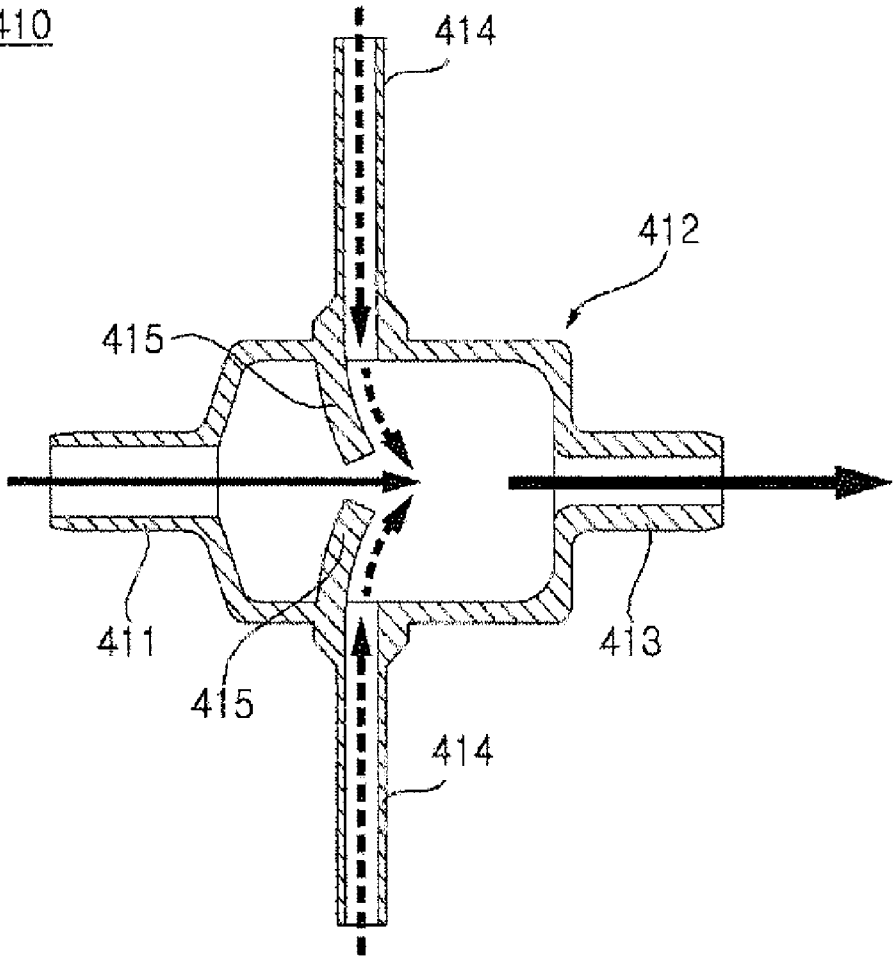
FIG. 15 is a front sectional view showing an air mixer according to a fifth embodiment of the present invention.

FIG. 15 is a front sectional view showing an air mixer according to a fifth embodiment of the present invention.

An air mixer 410 according to this embodiment is disposed such that the direction in which air is introduced is perpendicular to the flow direction of wash water.

Two air introduction parts 414 are provided.

The air mixer 410 includes a mixer body 412, in which wash water flows, the mixer body 412 including an inlet body 411 and an outlet body 414, the air introduction parts 414 for supplying air into the mixer body 412, and a guide 415 disposed in the mixer body 412 for guiding the air introduced through the air introduction parts 414.

The inlet body 411 and the outlet body 414 are disposed in a line.

The two air introduction parts 414 are disposed so as to be perpendicular to the flow direction of the wash water.

Consequently, the air introduction parts 414 are located at opposite sides of the mixer body 412.

Two guides 415 are disposed to guide air introduced through the air introduction parts 414.

The guides 415 are disposed so as to be spaced apart from each other at ends thereof.

The guides 415 are curved in the flow direction of wash water.

The guides 415 may be made of an elastic material so as to be curved by the flow of wash water.

Consequently, the air introduced through the air introduction parts 414 and the wash water introduced through the inlet body 411 may generate bubbles in a region between the guides 415.

In this embodiment, the two air introduction parts 414 are provided. Unlike this embodiment, a larger number of air introduction parts 414 may be provided.

In the air mixer 410 according to this embodiment, it is possible to inject a larger amount of air into the mixer body 412 through the two air introduction parts 414, thereby reducing the amount of wash water that is used.

The other construction of the second embodiment is identical to that of the first embodiment, and therefore a detailed description thereof will be omitted.

Figure 16:
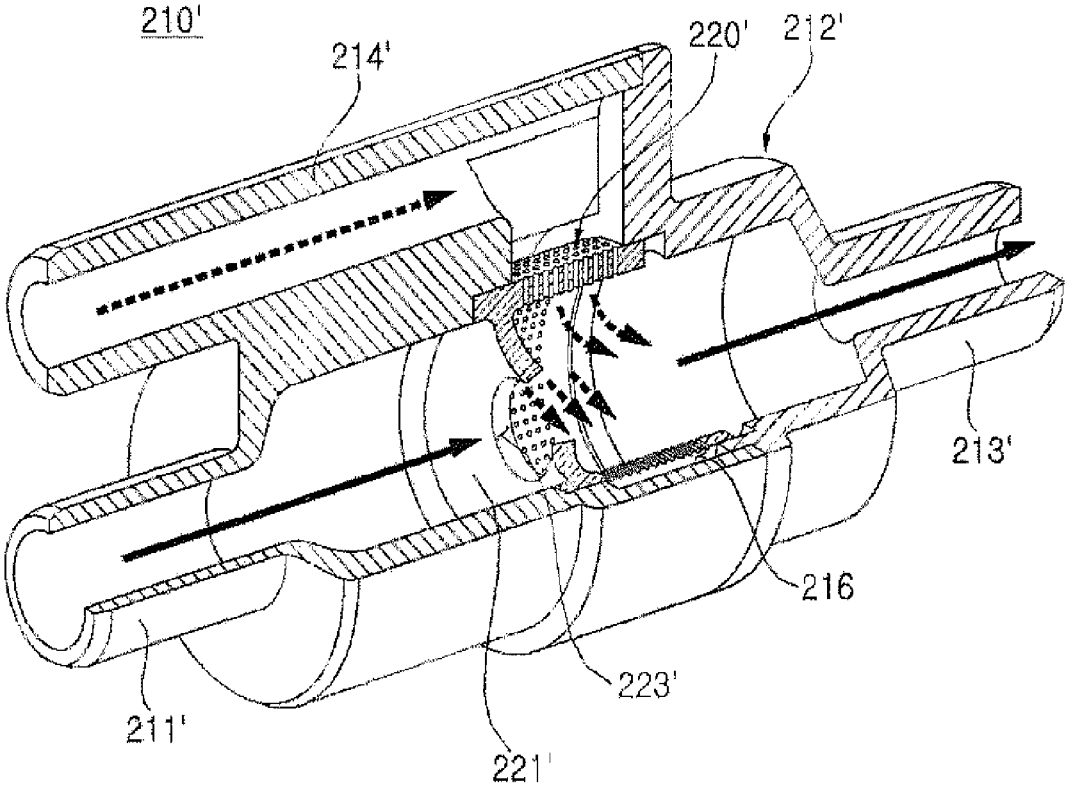
FIG. 16 is a partial cut-away perspective view showing an air mixer according to a sixth embodiment of the present invention.

FIG. 16 is a partial cut-away perspective view showing an air mixer according to a sixth embodiment of the present invention In an air mixer 210' according to this embodiment, a guide 221' is further provided at the inlet side of a mixer 220', unlike the third embodiment.

The guide 221' is formed at the inner surface of a mixer body 212' so as to protrude in the axial center direction. In this embodiment, the guide 221' is formed in a ring shape, and wash water flows through a guide hollow part 223' formed in the axial center.

Furthermore, the air discharged through the air introduction part 214' is guided to the axial center by the guide 221'.

The other construction of the second embodiment is identical to that of the third embodiment, and therefore a detailed description thereof will be omitted.

Figure 17:
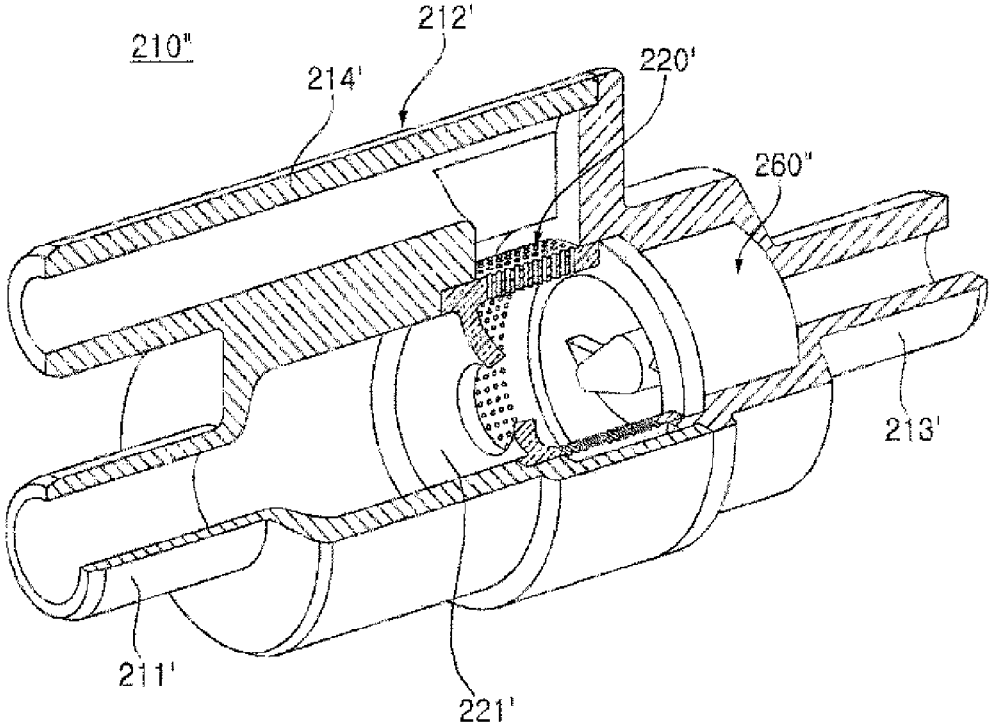
FIG. 17 is a partial cut-away perspective view showing an air mixer according to a seventh embodiment of the present invention.
Figure 18:
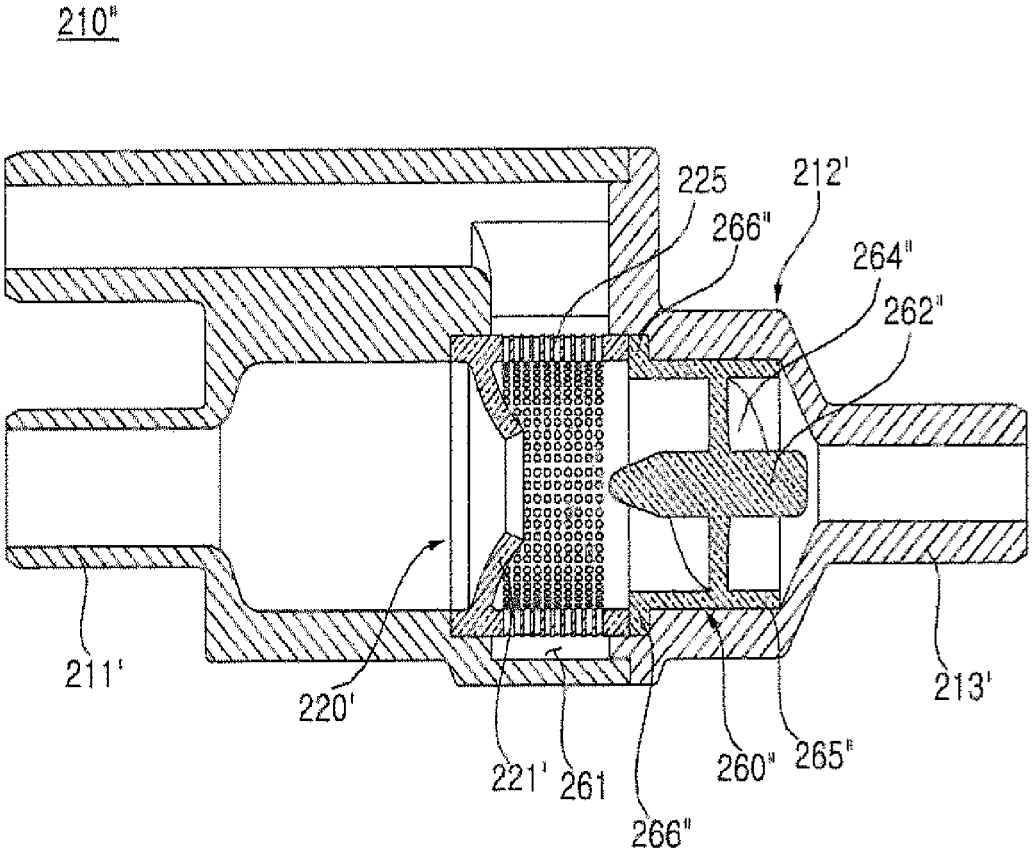
FIG. 18 is a front sectional view of FIG. 17.

FIG. 17 is a partial cut-away perspective view showing an air mixer according to a seventh embodiment of the present invention.

In an air mixer 210" according to this embodiment, a vane member 260" according to a second embodiment is further provided at the outlet side of an air mixer 210", unlike the sixth embodiment.

The mixer 220' is disposed between the inlet body 211' and the outlet body 213', and the vane member 260" is disposed in the outlet body 213'.

Like the second embodiment, the vane member 260" includes a vane column 262", a vane body 265", and a vane 264".

Additionally, in the vane member 260", a portion of the vane body 265" is bent to form a vane body catching part 266", and the vane body catching part 266" is caught by the mixer body 212', unlike the second embodiment.

In this embodiment, the vane body catching part 266" is fitted and fixed between the mixer 220' and the mixer body 212'.

The air mixer 210" according to this embodiment may mix air with wash water in the mixer body 210'. In addition, the wash water that has passed through the mixer 220' is swirled while passing through the vane member 260".

In the air mixer 210" according to this embodiment, therefore, wash water is simultaneously atomized and swirled.

The other construction of the second embodiment is identical to that of the sixth embodiment, and therefore a detailed description thereof will be omitted.

Figure 19:
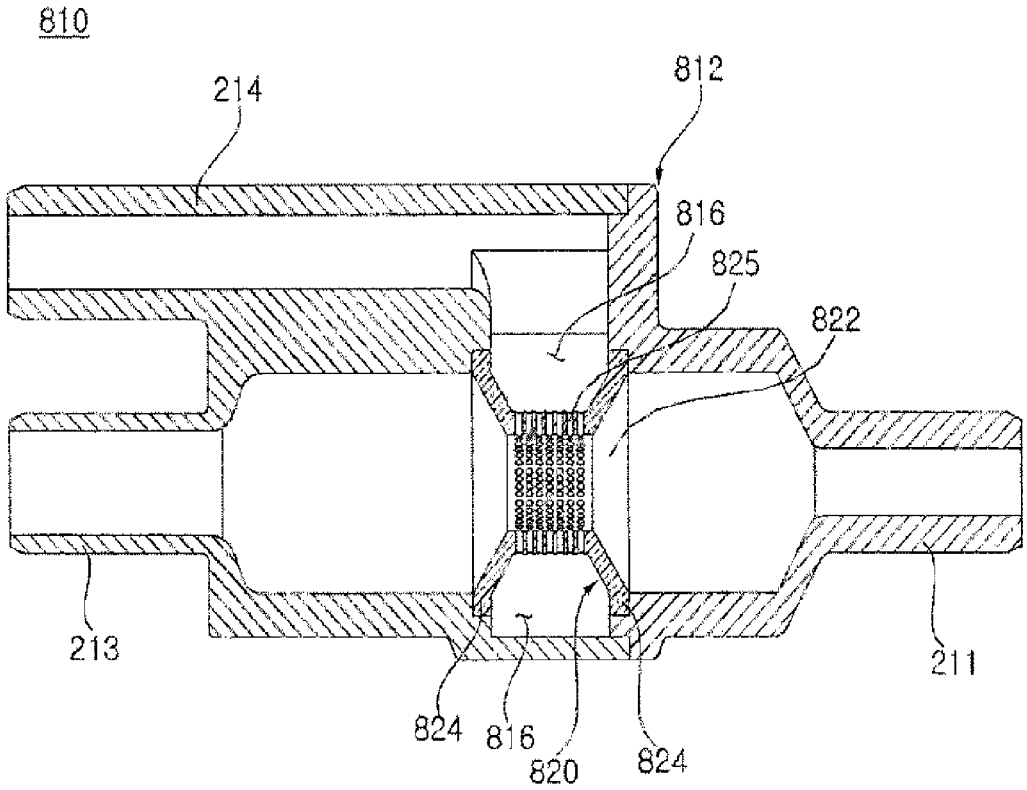
FIG. 19 is a front sectional view showing an air mixer according to an eighth embodiment of the present invention.

FIG. 19 is a front sectional view showing an air mixer according to an eighth embodiment of the present invention.

In an air mixer 810 according to this embodiment, the sectional diameter of a part in which mixer holes 825 are formed is smaller than in the first embodiment.

Consequently, a mixer 820 disposed in the air mixer 810 includes a dumbbell-shaped body part 822, a plurality of mixer holes 825 formed through the body part 822 in the axial center direction, and a body support part 824 formed at the body part 822 so as to be spaced apart from the mixer body 812 by a predetermined distance for defining a ring groove 816.

In the case in which the part of the body part 822 in which the mixer holes 825 are formed is defined as a mixer part, the diameter of the mixer part is small, and the diameter of the body support part 824 is greater than that of the mixer part.

In the air mixer 810 according to this embodiment, the ring groove 816 may be formed wider.

The other construction of the second embodiment is identical to that of the first embodiment, and therefore a detailed description thereof will be omitted.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. It should be noted that such modifications, additions and substitutions cannot be individually understood from technical concept or prospects of the present invention.

The invention claimed is:

1. A washing machine comprising:

a tub in which wash water is received;

a drum rotatably disposed in the tub;

a pump that circulates the wash water received in the tub;

a mixer body, in which the wash water flows;

an air introduction part formed in the mixer body for guiding air into the mixer body;

a mixer disposed in the mixer body for mixing the wash water with the air guided through the air introduction part; and a connection part, disposed in the mixer body, to communicate with the air introduction part, and to provide the air from the air introduction part to inside of the mixer body, wherein the mixer comprises:

a body part disposed in the mixer body;

a plurality of mixer holes formed through the body part; and a body support part formed at the body part, the body support part being supported by the mixer body, wherein the mixer holes are formed toward an axial center of the body part, wherein the mixer holes to communicate the air from the air introduction part to the inside of the mixer body.

2. The washing machine according to claim 1, wherein the mixer body comprises:

an inlet body, into which the wash water is introduced; and an outlet body, from which the wash water is discharged.

3. The washing machine according to claim 2, wherein the air introduction part is integrally formed with any one selected from between the inlet body and the outlet body.

4. The washing machine according to claim 2, wherein the mixer is disposed between the inlet body and the outlet body.

5. The washing machine according to claim 1, wherein the air guided through the air introduction part is atomized while passing through a mixer hole formed in the mixer and is then mixed with the wash water.

6. The washing machine according to claim 1, wherein the air introduction part is disposed such that the air flows in a direction opposite a direction in which the wash water flows and is then mixed with the wash water.

7. The washing machine according to claim 1, wherein the connection part changes a direction in which the air guided through the air introduction part flows such that the air is guided into the mixer body.

8. The washing machine according to claim 1, wherein the mixer body is further provided therein with a ring groove for guiding the air guided through the air introduction part so as to flow along an outside of the mixer.

9. The washing machine according to claim 8, wherein the body support part is bent outside in a radial direction, and wherein the ring groove is disposed between the body part and an inner surface of the mixer body.

10. The washing machine according to claim 9, wherein the mixer holes are formed in a surface that contacts the ring groove.

11. The washing machine according to claim 1, wherein the mixer body is further provided therein with a vane member for swirling wash water that flows.

12. The washing machine according to claim 11, wherein the vane member is disposed at a discharge side of the mixer body to swirl the wash water that has passed through the mixer.

13. The washing machine according to claim 11, wherein the vane member comprises:

a vane body fixed in the mixer body;

a vane column located at an axial center of the mixer body and extending in a direction in which the wash water flows; and a vane configured to connect the vane column and the vane body and to provide rotational force to the wash water that flows.

14. The washing machine according to claim 13, wherein the vane is formed around the vane column in a spiral shape.

15. The washing machine according to claim 13, wherein the vane comprises at least two vanes.

16. A washing machine comprising:

a tub in which wash water is received;

a drum rotatably disposed in the tub;

a pump that circulates the wash water received in the tub;

a mixer body comprising an inlet body, into which the wash water is introduced, and an outlet body, from which the wash water is discharged;

an air introduction part formed in the mixer body for guiding air into the mixer body;

a mixer disposed between the inlet body and the outlet body for mixing the wash water with the air guided through the air introduction part; and a connection part, disposed in the mixer body, to communicate with the air introduction part, and to provide the air from the air introduction part to inside of the mixer body, wherein the mixer comprises:

a body part disposed in the mixer body;

a plurality of mixer holes formed through the body part;

a body support part formed at the body part, the body support part being supported by the mixer body; and a ring groove formed between the body part and the mixer body for guiding the air guided through the air introduction part so as to flow along an outside of the mixer body, wherein the mixer holes are formed toward an axial center of the body part, wherein the mixer holes to communicate the air from the air introduction part to the inside of the mixer body and to communicate the air guided by the ring groove to the inside of the mixer body.

17. A washing machine comprising:

a tub in which wash water is received;

a drum rotatably disposed in the tub;

a pump that circulates the wash water received in the tub;

a mixer body, in which the wash water flows;

an air intake to be formed in the mixer body for guiding air into the mixer body;

a mixer disposed in the mixer body for mixing the wash water with the air guided through the air intake; and a connector to be coupled to the air intake and to the mixer, wherein the mixer comprises:

a body disposed in the mixer body;

a plurality of holes formed through the body; and a support coupled at the body and supporting the body in the mixing body, the support being supported by the mixer body, wherein the holes are formed toward an axial center of the body, wherein the air from the air intake flows through the holes to the inside of the mixer body.

* * * * *